US010399579B2

(12) United States Patent
Okumura

(10) Patent No.: US 10,399,579 B2
(45) Date of Patent: Sep. 3, 2019

(54) AXLE BOX SUSPENSION OF RAILCAR BOGIE

(71) Applicant: KAWASAKI JUKOGYO KABUSHIKI KAISHA, Kobe-shi, Hyogo (JP)

(72) Inventor: Yasufumi Okumura, Kobe (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 108 days.

(21) Appl. No.: 15/548,360

(22) PCT Filed: Jan. 25, 2016

(86) PCT No.: PCT/JP2016/000342
§ 371 (c)(1),
(2) Date: Aug. 2, 2017

(87) PCT Pub. No.: WO2016/125447
PCT Pub. Date: Aug. 11, 2016

(65) Prior Publication Data

US 2018/0029617 A1 Feb. 1, 2018

(30) Foreign Application Priority Data

Feb. 2, 2015 (JP) ..... 2015-018102

(51) Int. Cl.
*B61F 5/26* (2006.01)
*B61F 5/52* (2006.01)
*B61F 5/30* (2006.01)

(52) U.S. Cl.
CPC ..... *B61F 5/26* (2013.01); *B61F 5/302* (2013.01); *B61F 5/52* (2013.01)

(58) Field of Classification Search
CPC ..... B61F 5/26; B61F 5/302; B61F 5/52
See application file for complete search history.

(56) References Cited

U.S. PATENT DOCUMENTS 2,099,817 A * 11/1937 Mahana ..... B61C 9/10 105/102
2,740,622 A * 4/1956 Hickman ..... B60G 11/38 267/25

(Continued)

FOREIGN PATENT DOCUMENTS

CN 201193037 Y 2/2009
JP H08-268276 A 10/1996

(Continued)

OTHER PUBLICATIONS

Apr. 19, 2016 Search Report issued in International Patent Application No. PCT/JP2016/000342.

*Primary Examiner* — Jason C Smith
(74) *Attorney, Agent, or Firm* — Oliff PLC

(57) ABSTRACT

An axle box suspension of a railcar bogie is configured to couple an axle box, accommodating a bearing supporting an axle, to a bogie frame and includes: an axle beam including an axle beam main body portion and an axle beam end portion, the axle beam main body portion extending from the axle box in a car longitudinal direction, the axle beam end portion being provided at a tip end of the axle beam main body portion and including a tubular portion that is open at both car width direction sides; a core rod inserted into an internal space of the tubular portion in a car width direction; an elastic bushing interposed between the tubular portion and the core rod; and a receiving seat provided at the bogie frame, both end portions of the core rod being connected to the receiving seat, the tubular portion being divided into a first semi-tubular portion and a second semi-tubular portion, the first semi-tubular portion being formed integrally with the axle beam main body portion, the second semi-tubular portion being stacked on the first semi-tubular portion in an upward/downward direction.

6 Claims, 5 Drawing Sheets

(56) References Cited

U.S. PATENT DOCUMENTS

| | | | | | |
|---|---|---|---|---|---|
| 3,013,808 | A * | 12/1961 | Willetts | B60G 5/06 | 267/282 |
| 3,101,938 | A * | 8/1963 | Hirst | B60G 11/23 | 267/25 |
| 3,948,188 | A * | 4/1976 | Zehnder | B60G 11/04 | 105/167 |
| 4,166,611 | A * | 9/1979 | Geers | B61F 5/305 | 267/3 |
| 4,356,775 | A * | 11/1982 | Paton | B60G 5/04 | 105/182.1 |
| 4,619,544 | A * | 10/1986 | Laidely | B60G 5/02 | 16/2.1 |
| 4,690,069 | A * | 9/1987 | Willetts | B60G 11/23 | 105/165 |
| 5,189,962 | A * | 3/1993 | Iwamura | B61F 5/30 | 105/218.2 |
| 2004/0123769 | A1 * | 7/2004 | Nishimura | B60G 11/14 | 105/218.2 |
| 2011/0253004 | A1 * | 10/2011 | Nishimura | B61F 5/325 | 105/220 |
| 2015/0344046 | A1 | 12/2015 | Nishimura et al. | | |

FOREIGN PATENT DOCUMENTS

| | | | |
|---|---|---|---|
| JP | H10-278791 | A | 10/1998 |
| JP | 2015-018102 | A | 1/2015 |
| WO | 2014/109279 | A1 | 7/2014 |

* cited by examiner

AXLE BOX SUSPENSION OF RAILCAR BOGIE

TECHNICAL FIELD

The present invention relates to an axle box suspension of a railcar bogie, and particularly to a coupling mechanism coupling an axle beam and a bogie frame.

BACKGROUND ART

In a bogie of a railcar, an axle box accommodating a bearing supporting a wheelset is elastically supported by an axle box suspension with appropriate rigidity so as to be displaceable relative to a bogie frame in forward, rearward, leftward, and rightward directions. There exist various types of axle box suspensions. According to an axle beam type axle box suspension, an axle spring constituted by a coil spring is provided between an axle box and a bogie frame, and an axle beam extending from the axle box in a car longitudinal direction is elastically supported by a receiving seat of the bogie frame (see PTL 1, for example).

The axle beam includes: an axle beam main body portion extending from the axle box in the car longitudinal direction; and an axle beam end portion provided at a tip end of the axle beam main body portion and including a tubular portion that is open at both car width direction sides. A core rod is inserted into the tubular portion through a rubber bushing and is fixed to the receiving seat of the bogie frame. To insert the rubber bushing and the core rod into the tubular portion, the tubular portion is divided in the car longitudinal direction along a parting line extending in an upward/downward direction. Specifically, the tubular portion is divided into a first semi-tubular portion formed integrally with the axle beam main body portion and a second semi-tubular portion stacked on the first semi-tubular portion in the car longitudinal direction. A bolt is inserted into the first semi-tubular portion and the second semi-tubular portion in the car longitudinal direction.

CITATION LIST

Patent Literature

PTL 1: Japanese Laid-Open Patent Application Publication No. 10-278791

SUMMARY OF INVENTION

Technical Problem

However, according to a bogie including a tread brake, when a brake shoe is pressed against a wheel tread of a wheel in the car longitudinal direction at the time of braking, brake force applied to the wheel in the car longitudinal direction is transmitted to the axle beam through an axle and the axle box, and force acts in such a direction that the first semi-tubular portion and the second semi-tubular portion are separated from each other in the car longitudinal direction. Therefore, the brake force is applied to the bolt as pulling force acting in a direction (car longitudinal direction) along an axis of the bolt. On this account, strength design such as usage of a high-strength bolt needs to be considered.

An object of the present invention is to provide a configuration in a mechanism coupling an axle box to a bogie frame through an axle beam, the configuration being advantageous in terms of strength.

Solution to Problem

An axle box suspension of a railcar bogie according to one aspect of the present invention is an axle box suspension of a railcar bogie, the axle box suspension being configured to couple an axle box to a bogie frame, the axle box accommodating a bearing supporting an axle, the axle box suspension including: an axle beam including an axle beam main body portion and an axle beam end portion, the axle beam main body portion extending from the axle box in a car longitudinal direction, the axle beam end portion being provided at a tip end of the axle beam main body portion and including a tubular portion that is open at both car width direction sides; a core rod inserted into an internal space of the tubular portion in a car width direction; an elastic bushing interposed between the tubular portion and the core rod; and a receiving seat provided at the bogie frame, both end portions of the core rod being connected to the receiving seat, the tubular portion being divided into a first semi-tubular portion and a second semi-tubular portion, the first semi-tubular portion being formed integrally with the axle beam main body portion, the second semi-tubular portion being stacked on the first semi-tubular portion in an upward/downward direction.

According to the above configuration, the tubular portion of the axle beam is divided into the first semi-tubular portion formed integrally with the axle beam main body portion and the second semi-tubular portion stacked on the first semi-tubular portion in the upward/downward direction. Therefore, when viewed from a center of the core rod, the first semi-tubular portion extends to an opposite side of the axle beam main body portion. Therefore, the first semi-tubular portion can receive loads transmitted through the axle box to the axle beam in both directions along the car longitudinal direction. On this account, it is possible to prevent a case where the load transmitted through the axle box to the axle beam in the car longitudinal direction acts in such a direction that the second semi-tubular portion is separated from the first semi-tubular portion. Thus, a requirement of attaching strength of the second semi-tubular portion attached to the first semi-tubular portion can be eased.

Advantageous Effects of Invention

The present invention can provide a configuration in a mechanism coupling an axle box to a bogie frame through an axle beam, the configuration being advantageous in terms of strength.

DESCRIPTION OF EMBODIMENTS

Hereinafter, an embodiment will be explained in reference to the drawings. In the following explanations, a direction in which a bogie travels and in which a carbody of a railcar extends is defined as a car longitudinal direction, and a crosswise direction perpendicular to the car longitudinal direction is defined as a car width direction. The car longitudinal direction is also referred to as a forward/rearward direction, and the car width direction is also referred to as a leftward/rightward direction.

Figure 1:
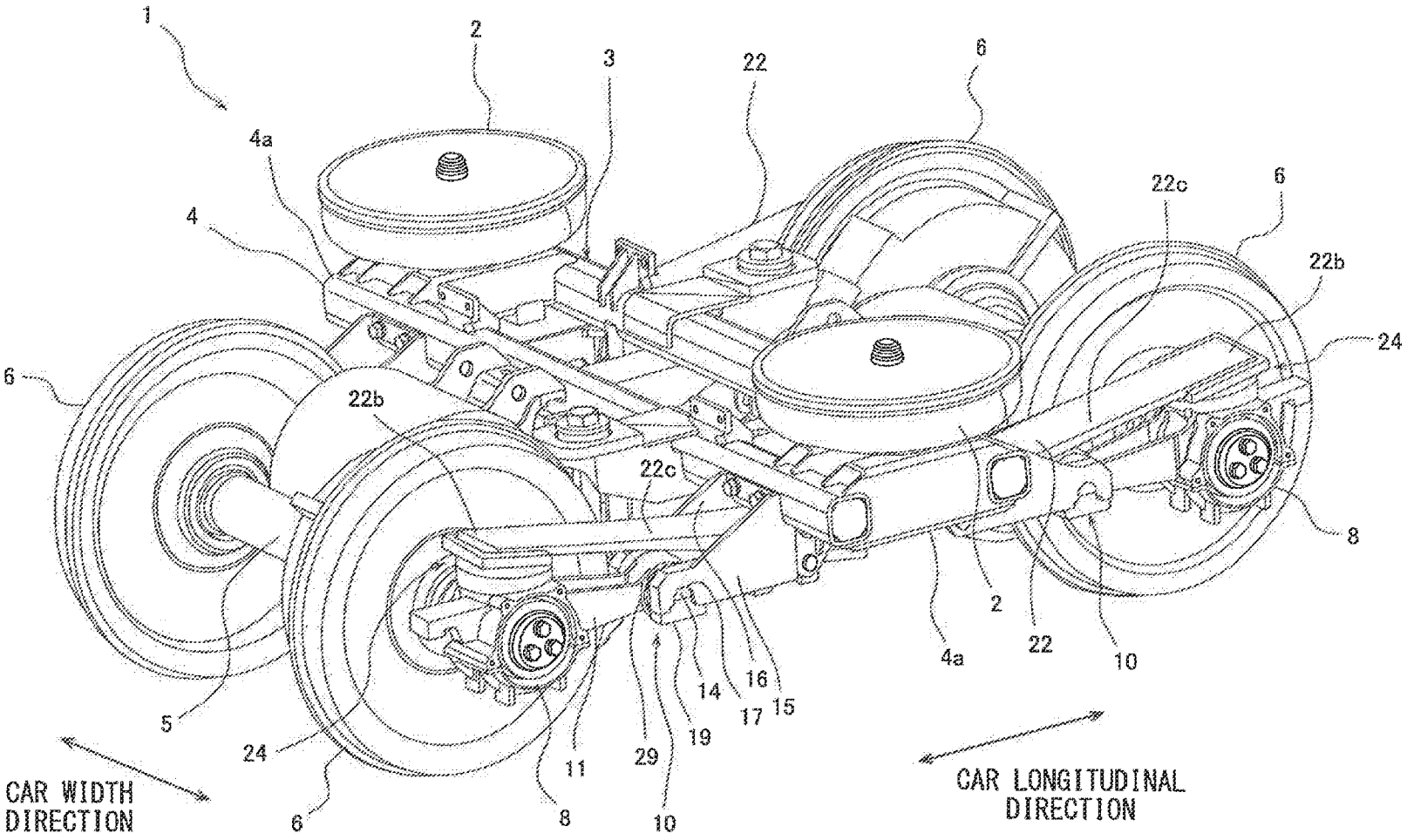
FIG. 1 is a perspective view of a railcar bogie according to an embodiment.
Figure 2:
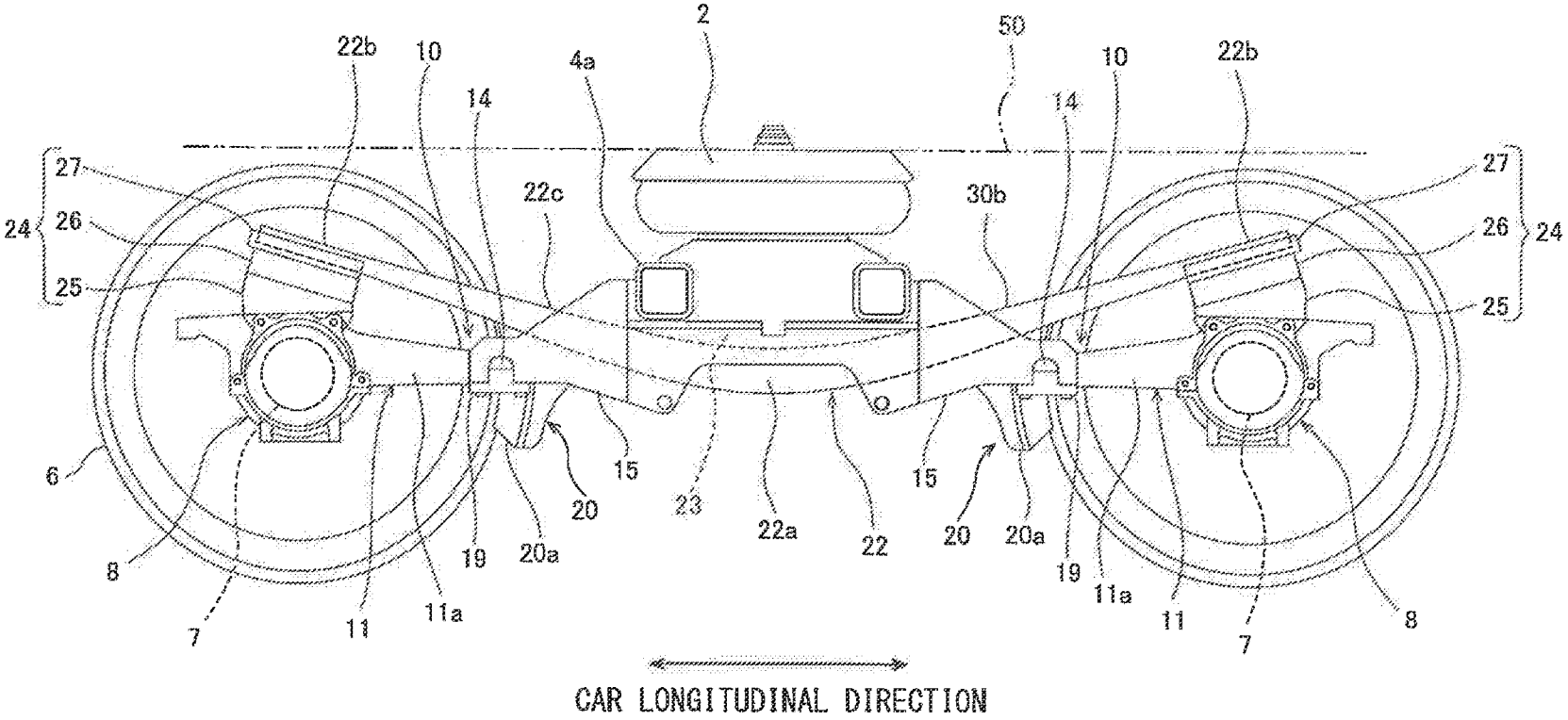
FIG. 2 is a side view of the bogie shown in FIG. 1.

FIG. 1 is a perspective view of a railcar bogie 1 according to the embodiment. FIG. 2 is a side view of the bogie 1 shown in FIG. 1. As shown in FIGS. 1 and 2, the bogie 1 includes a bogie frame 3 supporting a carbody 50 through air springs 2 that are secondary suspensions. The bogie frame 3 includes a cross beam 4 located at a longitudinal direction middle of the bogie 1 and extending in the car width direction. However, unlike the configuration of a conventional bogie frame, the bogie frame 3 does not include side sills extending from both respective car width direction end portions 4*a* of the cross beam 4 in the car longitudinal direction. Axles 5 extending in the car width direction are arranged at both respective car longitudinal direction sides of the cross beam 4, and wheels 6 are fixed to both respective car width direction sides of each of the axles 5. Bearings 7 rotatably supporting the axles 5 are provided at both respective car width direction side end portions of each of the axles 5 so as to be located outside the wheels 6 in the car width direction. The bearings 7 are accommodated in respective axle boxes 8.

Each of the axle boxes 8 is coupled to the corresponding car width direction end portion 4*a* of the cross beam 4 by a corresponding axle box suspension 10. The axle box suspension 10 includes an axle beam 11 extending from the axle box 8 toward the cross beam 4 in the car longitudinal direction. To be specific, the bogie 1 is a so-called axle beam type bogie. A tubular portion 29 that is open at both car width direction sides is provided at a tip end portion of the axle beam 11. A core rod 14 is inserted into an internal space of the tubular portion 29 through a rubber bushing 13 (see FIG. 6) as an elastic bushing. A pair of receiving seats 15 and 16 constituting the axle box suspension 10 is provided at the car width direction end portion 4*a* of the cross beam 4 so as to project outward in the car longitudinal direction. The receiving seats 15 and 16 are provided with groove portions 17 and 18, respectively, and the groove portions 17 and 18 are open downward. Both car width direction end portions of the core rod 14 are fitted to the respective groove portions 17 and 18 from below. In this state, lid members 19 are fixed to the respective receiving seats 15 and 16 from below by bolts (not shown) so as to close lower openings of the groove portions 17 and 18. Thus, the core rod 14 is sandwiched by the receiving seats 15 and 16 and the lid members 19. As above, the core rod 14 is connected to the receiving seats 15 and 16.

Brake devices 20 configured to brake the wheels 6 are provided at the cross beam 4. Each of the brake devices 20 includes a brake shoe 20*a* opposing a wheel tread of the wheel 6 from an inner side (the cross beam 4 side) in the car longitudinal direction. The brake device 20 is a tread brake configured to drive the brake shoe 20*a* by an electric, pneumatic, or hydraulic actuator (not shown) such that the brake shoe 20*a* is brought into contact with or separated from the wheel tread of the wheel 6. To be specific, the brake device 20 brakes the wheel 6 in such a manner as to press the brake shoe 20*a* against the wheel tread of the wheel 6 outward (toward an opposite side of the cross beam 4 side) in the carbody longitudinal direction. Therefore, at the time of braking, a load (brake force) acts on the wheel 6 outward in the car longitudinal direction.

Each of plate springs 22 extending in the car longitudinal direction is provided between the cross beam 4 and the axle box 8. Longitudinal direction middle portions 22*a* of the plate springs 22 support both respective car width direction end portions 4*a* of the cross beam 4 from below. Both longitudinal direction end portions 22*b* of each of the plate springs 22 are supported by the respective axle boxes 8. To be specific, the plate spring 22 achieves both a function of a primary suspension and a function of a conventional side sill. The longitudinal direction middle portions 22*a* of the plate springs 22 are arranged so as to extend under the cross beam 4. Pressing members 23 each having a circular-arc lower surface are provided at respective lower portions of the car width direction end portions 4*a* of the cross beam 4. Each of the pressing members 23 is placed on the longitudinal direction middle portion 22*a* of the plate spring 22 from above and presses the plate spring 22 from above so as to be separable from the plate spring 22. To be specific, the pressing member 23 presses the middle portion 22*a* of the plate spring 22 by a downward load, applied from the cross beam 4 by gravity, so as not to fix the plate spring 22 in an upward/downward direction. It should be noted that the pressing member 23 may include a rubber sheet opposing the plate spring 22.

A supporting member 24 supporting the end portion 22*b* of the plate spring 22 from below is provided on the axle box 8. To be specific, the car longitudinal direction end portion 22*b* of the plate spring 22 contacts an upper surface of the supporting member 24 so as to be separable from the upper surface. Specifically, as described below, the supporting member 24 is formed by stacking an upper surface inclined member 25, a rubber stack body 26, and a receiving member 27 in the upward/downward direction. In a side view from the car width direction, the upper surface of the supporting member 24 is inclined obliquely downward toward the cross beam 4. To be specific, the upper surface of the supporting member 24 is inclined such that a car longitudinal direction inner side (the cross beam 4 side) thereof is located lower than a car longitudinal direction outer side thereof. A part of an intermediate portion 22*c* between the middle portion 22*a* and the end portion 22*b* in the plate spring 22 extends through a space sandwiched between the receiving seats 15 and 16 to reach a position under the cross beam 4. In a side view, the end portion 22*b* and intermediate portion 22*c* of the plate spring 22 are inclined downward toward the middle portion 22*a*, and the middle portion 22*a* of the plate spring 22 is located lower than the end portion 22*b* of the plate spring 22. To be specific, in a side view, the plate spring 22 is formed in a bow shape that is convex downward as a whole.

Figure 3:
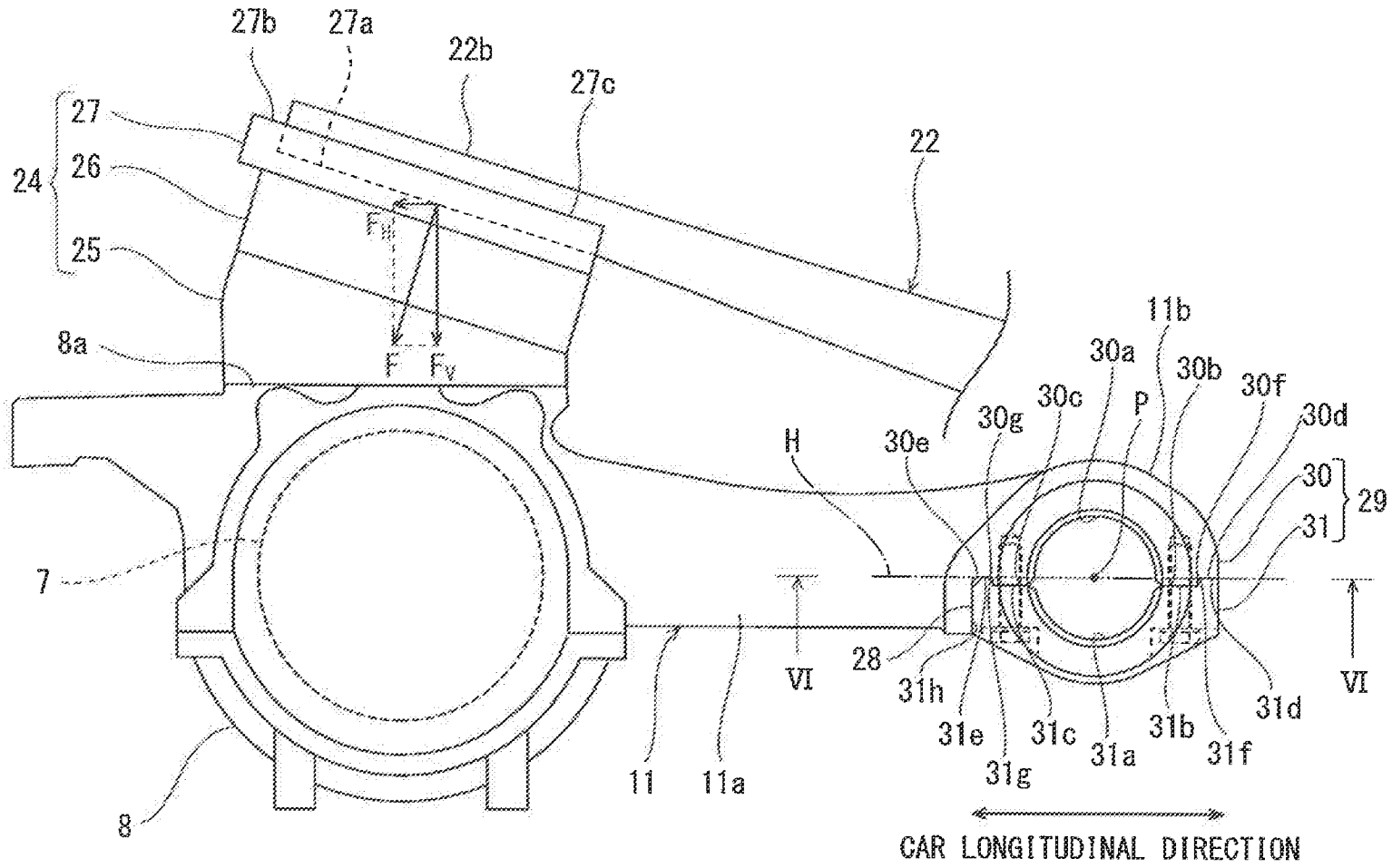
FIG. 3 is an enlarged view of major components of the bogie shown in FIG. 2.
Figure 4:
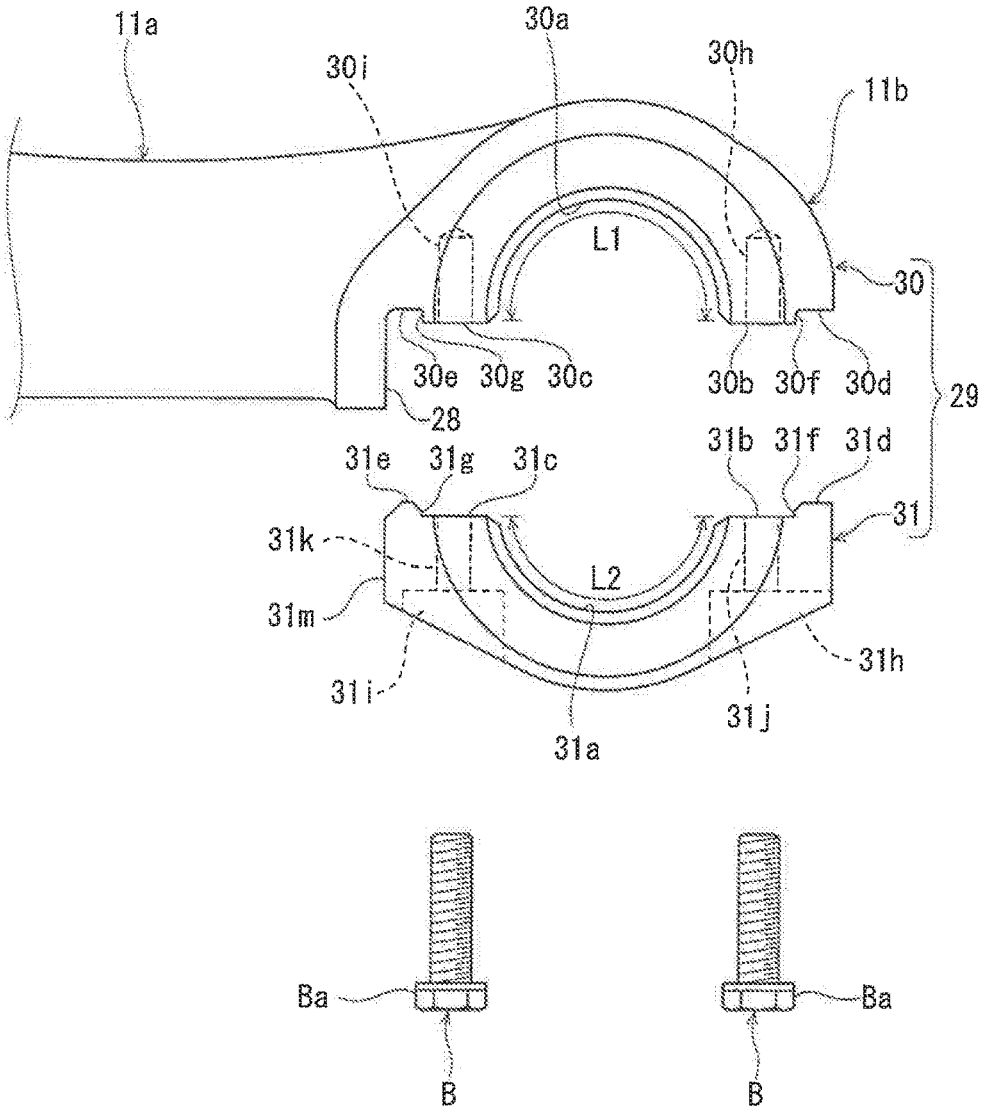
FIG. 4 is an exploded view of a tubular portion of an axle beam shown in FIG. 3.
Figure 5:
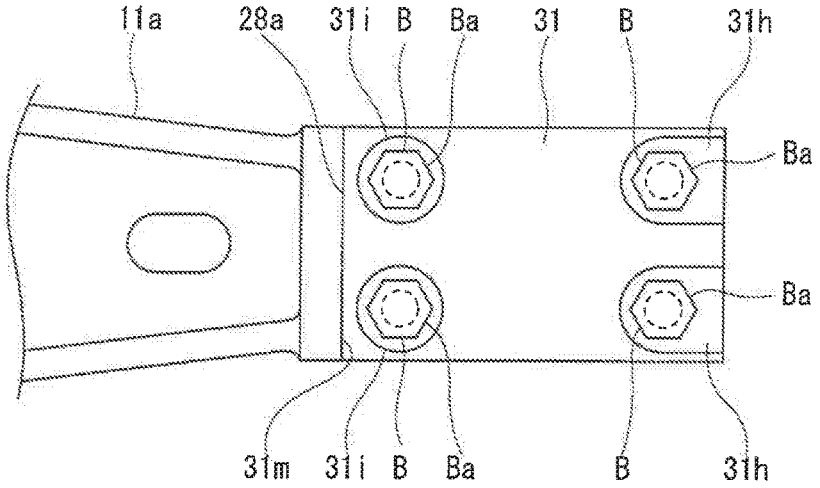
FIG. 5 is a bottom view of the tubular portion of the axle beam shown in FIG. 3.

FIG. 3 is an enlarged view of major components of the bogie 1 shown in FIG. 2. FIG. 4 is an exploded view of the tubular portion 29 of the axle beam 11 shown in FIG. 3. FIG. 5 is a bottom view of the tubular portion 29 of the axle beam 11 shown in FIG. 3. To improve visibility in FIG. 3, the rubber bushing 13, the core rod 14, the receiving seats 15 and 16, and the lid members 19 are omitted. As shown in FIG. 3, the supporting member 24 is formed by stacking the upper surface inclined member 25, the rubber stack body 26, and the receiving member 27 in this order from a lower side. An upper surface of the upper surface inclined member 25 is inclined such that a car longitudinal direction inner side thereof is located lower than a car longitudinal direction outer side thereof in a state where the upper surface inclined member 25 is provided on an upper surface 8*a* of the axle box 8. The rubber stack body 26 is attached to the upper surface of the upper surface inclined member 25, and the receiving member 27 is attached to an upper surface of the rubber stack body 26. The upper surface inclined member 25, the rubber stack body 26, and the receiving member 27 have such a structure (fitting structure, for example) as to be mutually positioned such that these components 25, 26, and 27 are not displaced relative to one another in a horizontal direction.

The receiving member 27 includes: a bottom wall portion 27*a* on which the plate spring 22 is placed from above; an end wall portion 27*b* projecting upward from a car longitudinal direction outer side of the bottom wall portion 27*a*; and a pair of side wall portions 27*c* projecting upward from both respective car width direction sides of the bottom wall portion 27*a*. An upper surface of the bottom wall portion 27*a* is inclined such that a car longitudinal direction inner side thereof is located lower than a car longitudinal direction outer side thereof. The end wall portion 27*b* opposes a longitudinal direction end surface of the end portion 22*b* of the plate spring 22 and restricts a movement of the plate spring 22 outward in the longitudinal direction. The side wall portions 27*c* oppose both respective car width direction side surfaces of the end portion 22*b* of the plate spring 22 and restrict a movement of the plate spring 22 toward both sides in the car width direction.

A carbody load transmitted from the cross beam 4 (see FIG. 2) to the plate spring 22 is transmitted from the end portion 22*b* of the plate spring 22 to the supporting member 24. In this case, since the upper surface of the supporting member 24 (the upper surface of the bottom wall portion 27*a* of the receiving member 27) is inclined, a downward carbody load F transmitted from the end portion 22*b* of the plate spring 22 to the supporting member 24 is inclined outward in the car longitudinal direction with respect to a vertical direction. Therefore, the carbody load F has a horizontal component $F_H$ and a vertical component $F_V$, and the horizontal component $F_H$ acts in such a direction that the axle box 8 is displaced outward in the car longitudinal direction (i.e., the axle box 8 is displaced in a direction away from the cross beam 4).

As shown in FIGS. 3 and 4, the axle beam 11 includes: an axle beam main body portion 11*a* extending from the axle box 8 in the car longitudinal direction; and an axle beam end portion 11*b* provided at a tip end of the axle beam main body portion 11*a* and including the tubular portion 29 that is open at both car width direction sides and has a cylindrical inner peripheral surface. The tubular portion 29 is divided into a first semi-tubular portion 30 and a second semi-tubular portion 31. The first semi-tubular portion 30 is formed continuously from and integrally with the axle beam main body portion 11*a*. The second semi-tubular portion 31 is stacked on the first semi-tubular portion 30 in the upward/downward direction.

The first semi-tubular portion 30 is formed continuously from an upper portion of the tip end of the axle beam main body portion 11*a* and projects inward in the car longitudinal direction. A lower portion of the tip end of the axle beam main body portion 11*a* includes an end surface 28 facing inward in the car longitudinal direction. The first semi-tubular portion 30 has a semi-cylindrical shape that is open downward. A lower end surface of the first semi-tubular portion 30 includes first main opposing surfaces 30*b* and 30*c* and second main opposing surfaces 30*d* and 30*e*. The first main opposing surfaces 30*b* and 30*c* are located adjacent to both respective ends of a semi-cylindrical inner surface 30*a* of the first semi-tubular portion 30. The second main opposing surface 30*d* is provided at a radially outer side of the first main opposing surface 30*b*, and the second main opposing surface 30*e* is provided at a radially outer side of the first main opposing surface 30*c*. The first main opposing surfaces 30*b* and 30*c* are located lower than the second main opposing surfaces 30*d* and 30*e*. It should be noted that the first main opposing surfaces 30*b* and 30*c* are located higher than a lower end of the axle beam main body portion 11*a*. The first main opposing surface (30*b*, 30*c*) is larger than the second main opposing surface (30*d*, 30*e*).

A first sub opposing surface 30*f* extending in the vertical direction and facing inward in the car longitudinal direction is formed at a car longitudinal direction inner side of a center of the tubular portion 29 so as to be located between the first main opposing surface 30*b* and the second main opposing surface 30*d*. To be specific, a first step that is offset in the vertical direction is formed on the lower end surface of the first semi-tubular portion 30 by the first main opposing surface 30*b*, the first sub opposing surface 30*f*, and the second main opposing surface 30*d*. A second sub opposing surface 30*g* extending in the vertical direction and facing outward in the car longitudinal direction is formed at a car longitudinal direction outer side of the center of the tubular portion 29 so as to be located between the first main opposing surface 30*c* and the second main opposing surface 30*e*. To be specific, a step that is offset in the vertical direction is formed on the lower end surface of the first semi-tubular portion 30 by the first main opposing surface 30*c*, the second sub opposing surface 30*g*, and the second main opposing surface 30*e*. Each of the first sub opposing surface 30*f* and the second sub opposing surface 30*g* is smaller than each of the first main opposing surfaces 30*b* and 30*c* and the second main opposing surfaces 30*d* and 30*e*. The second main opposing surface 30*e* located at the car longitudinal direction outer side of the center of the tubular portion 29 is continuous with the end surface 28 of the axle beam main body portion 11*a*.

The second semi-tubular portion 31 has a semi-cylindrical shape that is open upward. An upper end surface of the second semi-tubular portion 31 includes first main opposing surfaces 31*b* and 31*c* and second main opposing surfaces 31*d* and 31*e*. The first main opposing surfaces 31*b* and 31*c* are located adjacent to both respective ends of a semi-cylindrical inner surface 31*a* of the second semi-tubular portion 31. The second main opposing surface 31*d* is provided at a radially outer side of the first main opposing surface 31*b*, and the second main opposing surface 31*e* is provided at a radially outer side of the first main opposing surface 31*c*. The first main opposing surfaces 31*b* and 31*c* are located lower than the second main opposing surfaces 31*d* and 31*e*. A first sub opposing surface 31*f* extending in the vertical direction and facing outward in the car longitudinal direction is formed at the car longitudinal direction inner side of the center of the tubular portion 29 so as to be located between the first main opposing surface 31*b* and the second main opposing surface 31*d*. A second sub opposing surface 31*g* extending in the vertical direction and facing inward in the car longitudinal direction is formed at the car longitudinal direction outer side of the center of the tubular portion 29 so as to be located between the first main opposing surface 31*c* and the second main opposing surface 31*e*. To be specific, a step that is offset in the vertical direction is formed on the upper end surface of the second semi-tubular portion 31 by the first main opposing surface 31*b*, the first sub opposing surface 31*f*, and the second main opposing surfaces 31*d*, and another step that is offset in the vertical direction is formed on the upper end surface of the second semi-tubular portion 31 by the first main opposing surface 31*c*, the first sub opposing surface 31*g*, and the second main opposing surface 31*e*.

As shown in FIGS. 3 to 5, bolt holes 30*h* are formed on the first main opposing surface 30*b* of the first semi-tubular portion 30, and bolt holes 30*i* are formed on the first main opposing surface 30*c* of the first semi-tubular portion 30. Each of the bole holes 30*h* and 30*i* are concavely formed so as to extend upward and has an inner peripheral surface on which internal threads are formed. Depressed portions 31*h* and 31*i* that are depressed upward are formed on a bottom surface of the second semi-tubular portion 31. A bolt hole 31*j* is formed on an upper surface of the depressed portion 31*h* as a through hole extending upward so as to reach the first main opposing surface 31*b*, and a bolt hole 31*k* is formed on an upper surface of the depressed portion 31*i* as a through hole extending upward so as to reach the first main opposing surfaces 31*c*. The second semi-tubular portion 31 is fixed to the first semi-tubular portion 30 in such a manner that in a state where the second semi-tubular portion 31 is stacked on the first semi-tubular portion 30 from below, bolts B (fastening members) are inserted into the bolt holes 30*h*, 30*i*, 31*j*, and 31*k* from below. Head portions Ba of the bolts B are accommodated in the depressed portions 31*h* and 31*i* of the second semi-tubular portion 31.

The first main opposing surface 30*b* of the first semi-tubular portion 30 and the first main opposing surface 31*b* of the second semi-tubular portion 31 oppose each other in the upward/downward direction and contact each other, and the first main opposing surface 30*c* of the first semi-tubular portion 30 and the first main opposing surface 31*c* of the second semi-tubular portion 31 oppose each other in the upward/downward direction and contact each other. The second main opposing surface 30*d* of the first semi-tubular portion 30 and the second main opposing surface 31*d* of the second semi-tubular portion 31 oppose each other in the upward/downward direction and contact each other, and the second main opposing surface 30*e* of the first semi-tubular portion 30 and the second main opposing surface 31*e* of the second semi-tubular portion 31 oppose each other in the upward/downward direction and contact each other. The first sub opposing surface 30*f* of the first semi-tubular portion 30 and the first sub opposing surface 31*f* of the second semi-tubular portion 31 oppose each other in the car longitudinal direction and contact each other. The second sub opposing surface 30*g* of the first semi-tubular portion 30 and the second sub opposing surface 31*g* of the second semi-tubular portion 31 oppose each other in the car longitudinal direction and contact each other. A third sub opposing surface 31*m* that is a car longitudinal direction outer end surface of the second semi-tubular portion 31 opposes and contacts the end surface 28 of the axle beam main body portion 11*a*.

The first sub opposing surfaces 30*f* and 31*f* restrict displacement of the second semi-tubular portion 31 relative to the first semi-tubular portion 30 outward in the car longitudinal direction. The third sub opposing surface 31*m* of the second semi-tubular portion 31 and the end surface 28 of the axle beam main body portion 11*a* also restrict the displacement of the second semi-tubular portion 31 relative to the first semi-tubular portion 30 outward in the car longitudinal direction. On the other hand, the second sub opposing surfaces 30*g* and 31*g* restrict the displacement of the second semi-tubular portion 31 relative to the first semi-tubular portion 30 inward in the car longitudinal direction.

In a side view from the car width direction, a circumferential length L1 of the semi-cylindrical inner surface 30*a* of the first semi-tubular portion 30 is longer than a circumferential length L2 of the semi-cylindrical inner surface 31*a* of the second semi-tubular portion 31. Specifically, in a side view from the car width direction, a radially inner portion (i.e., a portion including the first main opposing surfaces 30*b* and 30*c*) of the first semi-tubular portion 30 projects toward the second semi-tubular portion 31 beyond a virtual line H extending through a center P of the tubular portion 29 and perpendicular to a direction in which the bolt B is inserted. With this, the first main opposing surfaces 30*b* and 30*c* of the first semi-tubular portion 30 are located lower than the virtual line H. It should be noted that in a side view, the virtual line H is a line parallel to the upper surface 8*a* (surface on which the supporting member 24 is placed) of the axle box 8.

Figure 6:
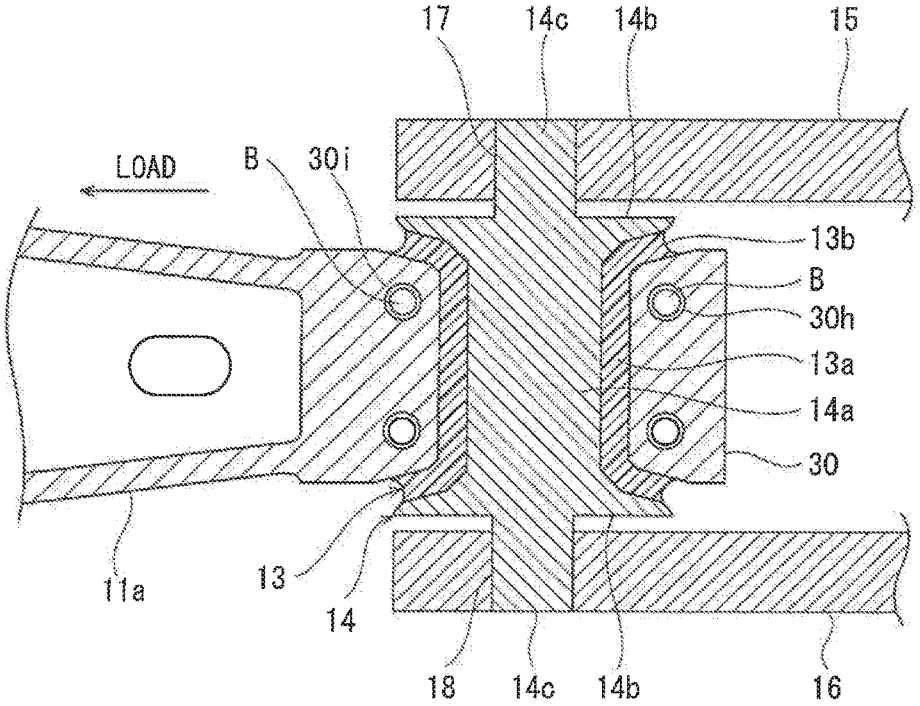
FIG. 6 is a sectional view taken along line VI-VI of FIG. 3.

FIG. 6 is a sectional view taken along line VI-VI of FIG. 3. As shown in FIG. 6, the core rod 14 is inserted into the internal space of the tubular portion 29 in the car width direction. The core rod 14 includes: a columnar portion 14*a*; a pair of conical flange portions 14*b* provided at both respective car width direction sides of the columnar portion 14*a*; and projecting end portions 14*c* each projecting from a side surface of the corresponding flange portion 14*b* outward in the car width direction. The rubber bushing 13 is interposed between the tubular portion 29 and the core rod 14. The rubber bushing 13 includes: a cylindrical portion 13*a*; and a pair of flange portions 13*b* projecting from both respective car width direction sides of the cylindrical portion 13*a* outward in a radial direction. The rubber bushing 13 is externally fitted to the core rod 14. To be specific, the cylindrical portion 13*a* of the rubber bushing 13 contacts the columnar portion 14*a* of the core rod 14, and the flange portions 13*b* of the rubber bushing 13 contact the respective flange portions 14*b* of the core rod 14.

The inner peripheral surface of the tubular portion 29 is formed by the inner surface 30*a* of the first semi-tubular portion 30 and the inner surface 31*a* of the second semi-tubular portion 31 and contacts outer peripheral surfaces of the cylindrical portion 13*a* and flange portions 13*b* of the rubber bushing 13. The core rod 14 is connected to the bogie frame 3 through the receiving seats 15 and 16 in such a manner that in a state where the end portions 14*c* of the core rod 14 are fitted to the respective groove portions 17 and 18 that are open downward on the receiving seats 15 and 16, respectively, the lid members 19 are fixed to the respective receiving seats 15 and 16 from below by bolts. By elasticity of the rubber bushing 13, the tubular portion 29 is allowed to be displaced relative to the core rod 14 in the car longitudinal direction, the car width direction, and the vertical direction.

According to the configuration explained above, the tubular portion 29 of the axle beam 11 is divided into the first semi-tubular portion 30 formed continuously from and integrally with the axle beam main body portion 11*a* and the second semi-tubular portion 31 stacked on the first semi-tubular portion 30 in the upward/downward direction. Therefore, when viewed from the center P of the core rod 14, the first semi-tubular portion 31 is provided so as to extend to an opposite side (the cross beam 4 side) of the axle beam main body portion 11*a*. On this account, the first semi-tubular portion 30 can receive loads transmitted through the axle box 8 to the axle beam 11 in both directions along the car longitudinal direction. Thus, it is possible to prevent a case where the load transmitted through the axle box 8 to the axle beam 11 in the car longitudinal direction acts in such a direction that the first semi-tubular portion 30 is separated from the second semi-tubular portion 31. Therefore, a requirement of attaching strength of the second semi-tubular portion 31 attached to the first semi-tubular portion 30 can be eased. To be specific, since the load applied to the bolts B is reduced, the requirement of the attaching strength of the bolts B is eased, and design burden is therefore reduced.

In the present embodiment, the horizontal component $F_H$ of the carbody load F transmitted through the plate spring 22 is applied to the axle beam 11 at all times as a load acting outward in the car longitudinal direction. Further, when braking the wheel 6, the brake force applied to the wheel 6 is applied to the axle beam 11 as a load acting outward in the car longitudinal direction. Therefore, a large load acting outward in the car longitudinal direction tends to be applied the axle beam 11 of the bogie 1 of the present embodiment, so that the above-described configuration of the tubular portion 29 is especially advantageous in terms of strength.

Further, the first semi-tubular portion 30 includes the first sub opposing surface 30*f* and the second sub opposing surface 30*g*, and the second semi-tubular portion 31 includes the first sub opposing surface 31*f* and the second sub opposing surface 31*g*. The first sub opposing surfaces 30*f* and 31*f* oppose each other in the car longitudinal direction, and the second sub opposing surfaces 30*g* and 31*g* oppose each other in the car longitudinal direction. Therefore, the sub opposing surfaces 30*f*, 31*f*, 30*g*, and 31*g* can receive a load acting in such a direction that the second semi-tubular portion 31 is displaced relative to the first semi-tubular portion 30 in the car longitudinal direction. Especially, the first sub opposing surfaces 30*f* and 31*f* restrict the displacement of the second semi-tubular portion 31 relative to the first semi-tubular portion 30 outward in the car longitudinal direction, and the second sub opposing surfaces 30*g* and 31*g* restrict the displacement of the second semi-tubular portion 31 relative to the first semi-tubular portion 30 inward in the car longitudinal direction. Therefore, shear force acting on the bolts B can be adequately suppressed.

The circumferential length L1 of the inner surface 30*a* located at a radially inner side of the first semi-tubular portion 30 is longer than the circumferential length L2 of the inner surface 31*a* located at a radially inner side of the second semi-tubular portion 31. Therefore, the first semi-tubular portion 30 can receive larger force than the second semi-tubular portion 31, the force being applied from the core rod 14 through the rubber bushing 13. Further, at an interface between the tubular portion 29 and the rubber bushing 13, the load transmitted through the axle box 8 to the axle beam 11 in the car longitudinal direction most largely acts on a horizontal line extending through the center P of the tubular portion 29. However, since the first semi-tubular portion 30 projects toward the second semi-tubular portion 31 beyond the horizontal virtual line H, and the inner surface 30*a* of the first semi-tubular portion 30 exists on the virtual line H, the above load is easily received by the first semi-tubular portion 30.

On this account, the load applied to the second semi-tubular portion 31 can be preferably made smaller than the load applied to the first semi-tubular portion 30. As a result, it is possible to further prevent the case where the load transmitted through the axle box 8 to the axle beam 11 in the car longitudinal direction acts in such a direction that the second semi-tubular portion 31 is separated from the first semi-tubular portion 30. In addition, the requirement of the attaching strength of the second semi-tubular portion 31 attached to the first semi-tubular portion 30 can be further preferably eased.

The present invention is not limited to the above embodiment, and modifications, additions, and eliminations may be made within the scope of the present invention. In the present embodiment, the main opposing surfaces of the first semi-tubular portion 30 and the main opposing surfaces of the second semi-tubular portion 31 are parallel to the upper surface 8*a* of the axle box 8. However, these main opposing surfaces may be inclined relative to the upper surface 8*a*. To be specific, in FIG. 3, the main opposing surfaces may be inclined relative to the virtual line H. This case only requires that: each of the main opposing surfaces is inclined in such an angular range that a car longitudinal direction component of a normal vector of the main opposing surface is larger than an upward/downward direction component of the normal vector; and therefore, the second semi-tubular portion 31 is stacked on the first semi-tubular portion 30 mainly in the upward/downward direction. Further, in the present embodiment, an upper portion of the tubular portion 29 is the first semi-tubular portion 30 formed integrally with the axle beam main body portion 11*a*, and a lower portion of the tubular portion 29 is the second semi-tubular portion 31 formed separately. However, the lower portion of the tubular portion may be the first semi-tubular portion formed integrally with the axle beam main body portion, and the upper portion of the tubular portion may be the second semi-tubular portion formed separately.

In the present embodiment, the upper surface of the supporting member 24 on which the plate spring 22 is placed is inclined. However, the upper surface of the supporting member 24 may be a horizontal surface. This case only requires that: it is possible to prevent a case where the load applied to the axle beam in the car longitudinal direction at the time of braking acts in such a direction that the second semi-tubular portion is separated from the first semi-tubular portion; and the load applied to a coupling portion where the bogie frame and the axle beam are coupled to each other can be reduced.

In the present embodiment, the displacement of the second semi-tubular portion 31 relative to the first semi-tubular portion 30 outward in the car longitudinal direction is restricted by both the contact of the first sub opposing surface 31*f* with the first sub opposing surface 30*f* and the contact of the third sub opposing surface 31*m* with the end surface 28 of the axle beam main body portion 11*a*. However, any one of the above contacts may be realized. Further, each of the opposing surfaces is not limited to a flat surface and may be a curved surface. The opposing surfaces opposing each other do not have to be in surface contact with each other and may be in line contact or point contact with each other. The rubber bushing 13 may be formed by an elastic material other than rubber. The axle box suspension 10 of the present embodiment is applied to the bogie 1 including the plate spring 22. However, it is also preferable to apply the axle box suspension 10 of the present embodiment to a steering bogie in which force in the car longitudinal direction tends to be generated at the axle box. Further, the bogie to which the axle box suspension 10 of the present embodiment is applied is not limited to the bogie including the plate spring or the steering bogie and may be a bogie including a typical axle beam type axle box suspension.

REFERENCE SIGNS LIST

1 bogie
3 bogie frame
5 axle
7 bearing
8 axle box
10 axle box suspension
11 axle beam

11*a* axle beam main body portion
11*b* axle beam end portion
13 rubber bushing (elastic bushing)
14 core rod
15, 16 receiving seat
29 tubular portion
30 first semi-tubular portion
30*a* inner surface
30*b*, 30*c* first main opposing surface
30*d*, 30*e* second main opposing surface
30*f* first sub opposing surface
30*g* second sub opposing surface
31 second semi-tubular portion
31*a* inner surface
31*b*, 31*c* first main opposing surface
31*d*, 31*e* second main opposing surface
31*f* first sub opposing surface
31*g* second sub opposing surface
31*m* third sub opposing surface
50 carbody
B bolt (fastening member)
H virtual line

The invention claimed is:

1. An axle box suspension of a railcar bogie, the axle box suspension being configured to couple an axle box to a bogie frame, the axle box accommodating a bearing supporting an axle, the axle box suspension comprising:

an axle beam including an axle beam main body portion and an axle beam end portion, the axle beam main body portion extending from the axle box in a car longitudinal direction, the axle beam end portion being provided at a tip end of the axle beam main body portion and including a tubular portion that is open at both car width direction sides;

a core rod inserted into an internal space of the tubular portion in a car width direction;

an elastic bushing interposed between the tubular portion and the core rod; and a receiving seat provided at the bogie frame, both end portions of the core rod being connected to the receiving seat, the tubular portion being divided into a first semi-tubular portion and a second semi-tubular portion, the first semi-tubular portion being formed integrally with the axle beam main body portion, the second semi-tubular portion being stacked on the first semi-tubular portion in an upward/downward direction, and wherein the second semi-tubular portion includes:

a main opposing surface opposing the first semi-tubular portion in the upward/downward direction, and a sub opposing surface opposing at least one of the first semi-tubular portion and the axle beam main body portion in the car longitudinal direction.

2. The axle box suspension according to claim 1, wherein the sub opposing surface includes:

a first sub opposing surface configured to restrict displacement of the second semi-tubular portion relative to the first semi-tubular portion in one direction along the car longitudinal direction; and a second sub opposing surface configured to restrict displacement of the second semi-tubular portion relative to the first semi-tubular portion in the other direction along the car longitudinal direction.

3. The axle box suspension according to claim 1, wherein when viewed from the car width direction, a circumferential length of a semi-cylindrical inner surface of the first semi-tubular portion is longer than a circumferential length of a semi-cylindrical inner surface of the second semi-tubular portion.

4. The axle box suspension according to claim 3, further comprising a fastening member inserted into the first semi-tubular portion and the second semi-tubular portion in the upward/downward direction to fix the second semi-tubular portion to the first semi-tubular portion, wherein when viewed from the car width direction, the first semi-tubular portion projects toward the second semi-tubular portion beyond a virtual line extending through a center of the tubular portion and perpendicular to a direction in which the fastening member is inserted.

5. The axle box suspension according to claim 2, wherein when viewed from the car width direction, a circumferential length of a semi-cylindrical inner surface of the first semi-tubular portion is longer than a circumferential length of a semi-cylindrical inner surface of the second semi-tubular portion.

6. The axle box suspension according to claim 5, further comprising a fastening member inserted into the first semi-tubular portion and the second semi-tubular portion in the upward/downward direction to fix the second semi-tubular portion to the first semi-tubular portion, wherein when viewed from the car width direction, the first semi-tubular portion projects toward the second semi-tubular portion beyond a virtual line extending through a center of the tubular portion and perpendicular to a direction in which the fastening member is inserted.

* * * * *